United States Patent [19]

Johnson

[11] Patent Number: 5,016,796

[45] Date of Patent: May 21, 1991

[54] SPEED SQUARE HOLDER

[76] Inventor: Earnest E. Johnson, 2666 W. Hwy. 45, Fayetteville, Ark. 72703

[21] Appl. No.: 601,344

[22] Filed: Oct. 23, 1990

[51] Int. Cl.[5] ..... B65D 25/10

[52] U.S. Cl. ..... 224/245; 224/253; 224/904; 206/371

[58] Field of Search ..... 224/253, 904, 252, 245, 224/242; 206/224, 214, 371; 33/484

[56] References Cited

U.S. PATENT DOCUMENTS

| | | | |
|---|---|---|---|
| D. 257,410 | 10/1980 | Rink | 224/904 |
| 1,633,319 | 6/1927 | Estwing | 224/253 |
| 3,516,584 | 6/1970 | Fabyan | 224/904 |
| 4,223,820 | 9/1980 | Vorsanger et al. | 224/253 |
| 4,819,847 | 4/1989 | Anderson | 224/904 |
| 4,872,600 | 10/1989 | Corbin | 224/253 |

*Primary Examiner*—Linda J. Sholl
*Attorney, Agent, or Firm*—Boyd D. Cox

[57] ABSTRACT

A holder for a right triangular speed square, having a transverse flange extending along one side, includes a pair of side panels disposed in spaced, parallel relation which define a hollow interior having front, rear and bottom openings in the form of elongated slots. An inclined rear wall connects the side panels and separates the rear and bottom openings. Apertures in the side panels cooperate with rivets to secure the holder to a carpenter's apron. The rear wall abuts a side of the speed square forming the hypotenuse. An elongated, rectangular tubular portion formed along top edges of the side panels possesses a floor with a central opening communicating with the hollow interior portion and defining aligned, opposed, spaced ledge members which abut the transverse flange. A pair of upstanding tabs disposed on the ledge members adjacent the front opening, on opposite sides of the central opening, engage a leading edge of the transverse flange. Juxtaposed inclined ramps extend inwardly from opposite sides of the tubular portion, above the ledge members, and adjacent the rear opening. The inclined ramps abut a rear portion of the transverse flange, to maintain the leading edge in engagement with the tabs, and allow removal of the speed square through the front opening by raising the leading edge above the tabs.

20 Claims, 2 Drawing Sheets

SPEED SQUARE HOLDER

BACKGROUND OF THE INVENTION

1. Field of the Invention

The present invention relates to speed square holders, and more particularly pertains to a holder for removably retaining a speed square on a carpenter's apron, tool belt, or the like, in a manner to allow convenient and expedient access and storage of the square.

2. Description of the Prior Art

Various types of speed square holders are known in the prior art. Typical examples of such speed square holders are to be found in U.S. Pat. Nos. 4,872,600 to Corbin, 4,223,820 to Vorsanger et al., 4,819,847 to Anderson, and Des. 257,410 to Rink. The entire disclosures of each of the preceding U.S. patents are incorporated herein by reference. The construction and manner of use of speed squares is well known in the art, as described in these patents.

SUMMARY OF THE INVENTION

Representative embodiments of the concepts of the present invention are illustrated in the drawings and make use of a holder for a right triangular speed square, having a transverse flange extending along one side, which includes a pair of side panels disposed in spaced, parallel relation which define a hollow interior having front, rear and bottom openings in the form of elongated slots. An inclined rear wall connects the side panels and separates the rear and bottom openings. Apertures in the side panels cooperate with rivets to secure the holder to a carpenter's apron. The rear wall abuts a side of the speed square forming the hypotenuse. An elongated, rectangular tubular portion formed along top edges of the side panels possesses a floor with a central opening communicating with the hollow interior portion and defining aligned, opposed, spaced ledge members which abut the transverse flange. A pair of upstanding tabs disposed on the ledge members adjacent the front opening, on opposite sides of the central opening, engage a leading edge of the transverse flange. Juxtaposed inclined ramps extend inwardly from opposite sides of the tubular portion, above the ledge members, and adjacent the rear opening. The inclined ramps abut a rear portion of the transverse flange, to maintain the leading edge in engagement with the tabs, and allow removal of the speed square through the front opening by raising the leading edge above the tabs.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a plan view of a rivet and washer for use in securing the speed square holder to a carpenter's apron, tool belt, or the like.

DESCRIPTION OF THE PREFERRED EMBODIMENT

Figure 1:
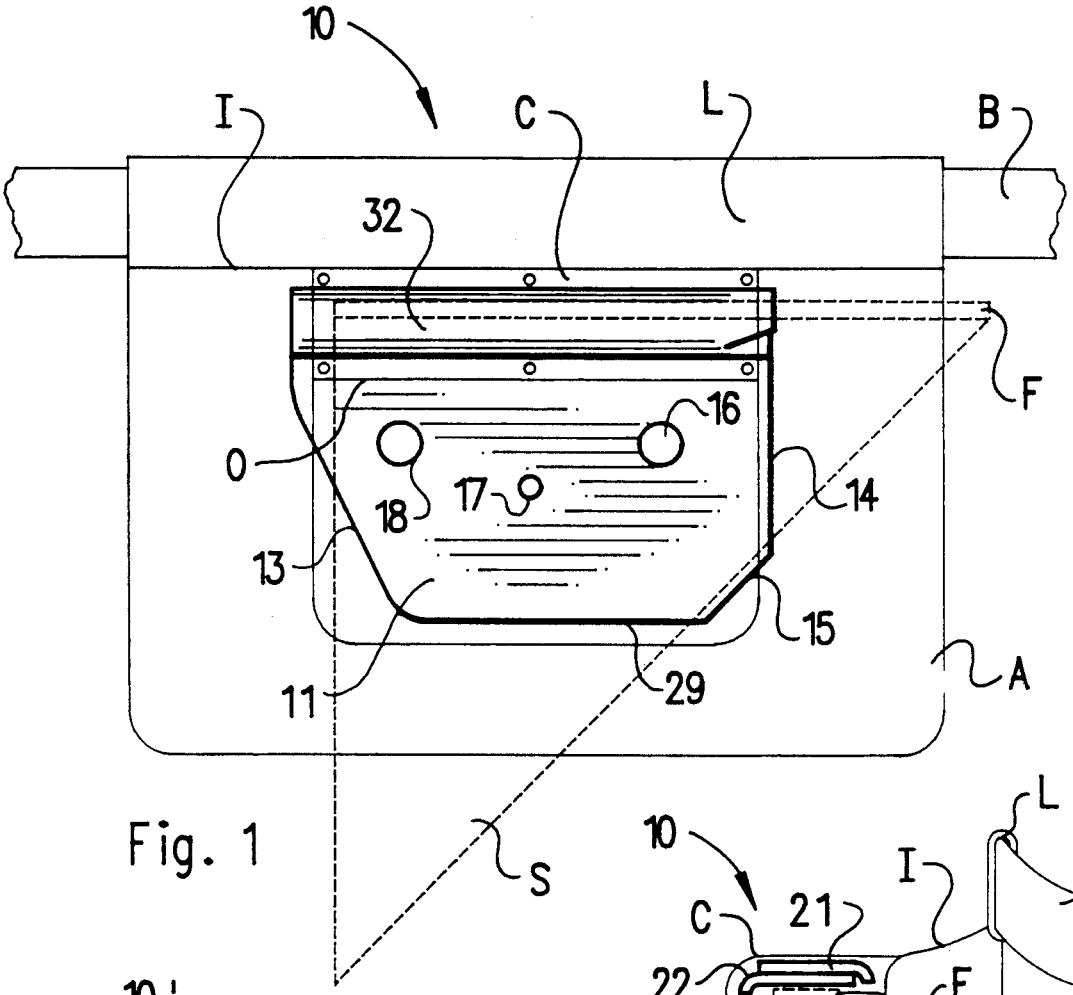
FIG. 1 is a diagrammatic side view of the speed square holder according to a first embodiment of the invention mounted on a carpenter's apron.

With reference now to the drawings, and in particular to FIGS. 1–4 thereof, a new and improved speed square holder embodYing the principles and concepts of the present invention and generally designated by the reference numeral 10 will be described.

Figure 2:
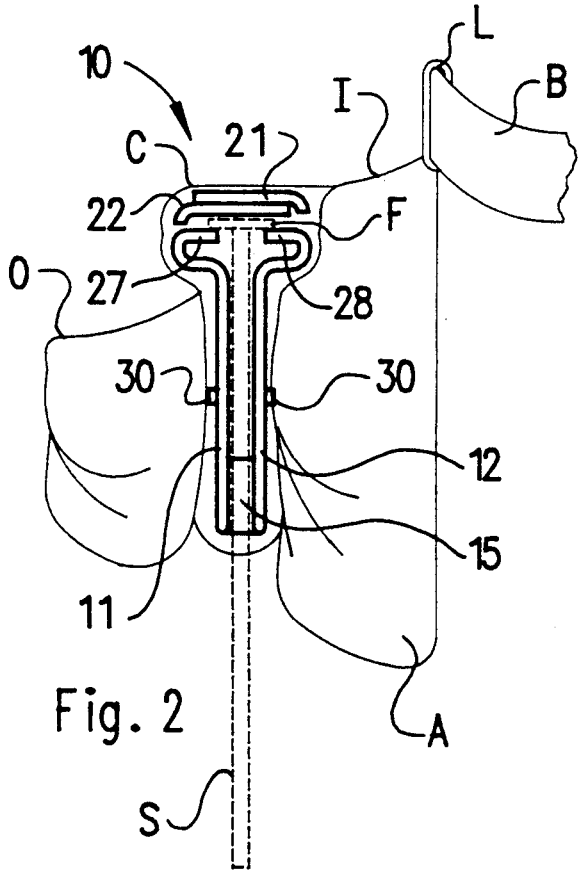
FIG. 2 is a right end view of FIG. 1.

More specifically, it will be noted that the first embodiment 10 of the invention is directed to a holder for removably retaining a right triangular speed square S, of the type having a transverse flange extending along one side edge. The holder 10 includes a pair of side panels 11 and 12 disposed in spaced, parallel relation which define a housing having a hollow interior having front 13, rear 14 and bottom 29 openings in the form of elongated slots. An inclined rear wall 15 connects the side panels 11 and 12 and separates the rear 14 and bottom 29 openings. Apertures 16, 17 and 18 in the side panels cooperate with rivets 30 as shown in FIG. 2, to secure the holder 10 to a carpenter's apron A. It should be understood that the holder 10 may be employed with a tool belt, or the like, without departing from the scope of the invention.

Figure 6:
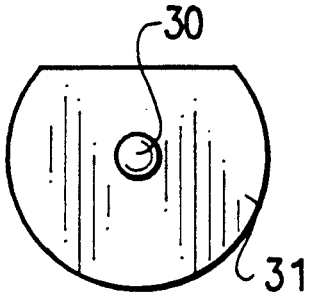

As shown in FIGS. 1 and 2, the apron A includes an inner pocket I and an outer pocket 0 joined by a fabric connecting strip C. A loop L secures the apron A to a belt B adapted to be worn by a carpenter or other individual. In FIG. 1, the connecting strip C and the outer pocket 0 are shown as if transparent, so as to clearly illustrate the holder 10. The holder 10 is disposed beneath the connecting strip C and between the pockets I and O, as can best be appreciated with reference to FIG. 2. Rivets 30 extend through the holes 16, 17, 18 in each of the side panels 11 and 12, and into engagement with the fabric of respective pockets O and I. It should be noted that the rivets do not extend completely through the holder 10, between the panels 11 and 12, as this would prevent the insertion of the square S. Instead, separate rivets are employed to separately secure the panels 11 and 12 to the pockets O and I. As shown in FIG. 6, washers 31 may be utilized in conjunction with the rivets 30 to prevent the rivets 30 from pulling through the fabric of the carpenter's apron A. Other fastening techniques, such as stitching, stapling, screws and adhesives may also be employed, within the concepts of the present invention.

Figure 7:
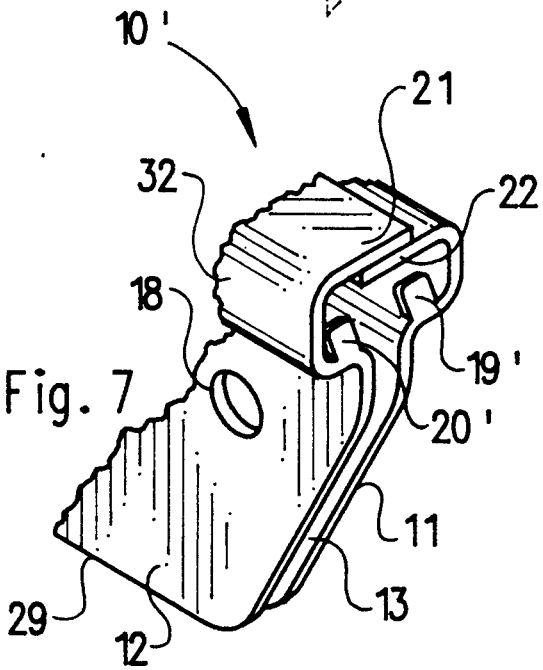
FIG. 7 is a partial perspective view illustrating a speed square holder according to a slightly modified embodiment of the invention.
Figure 3:
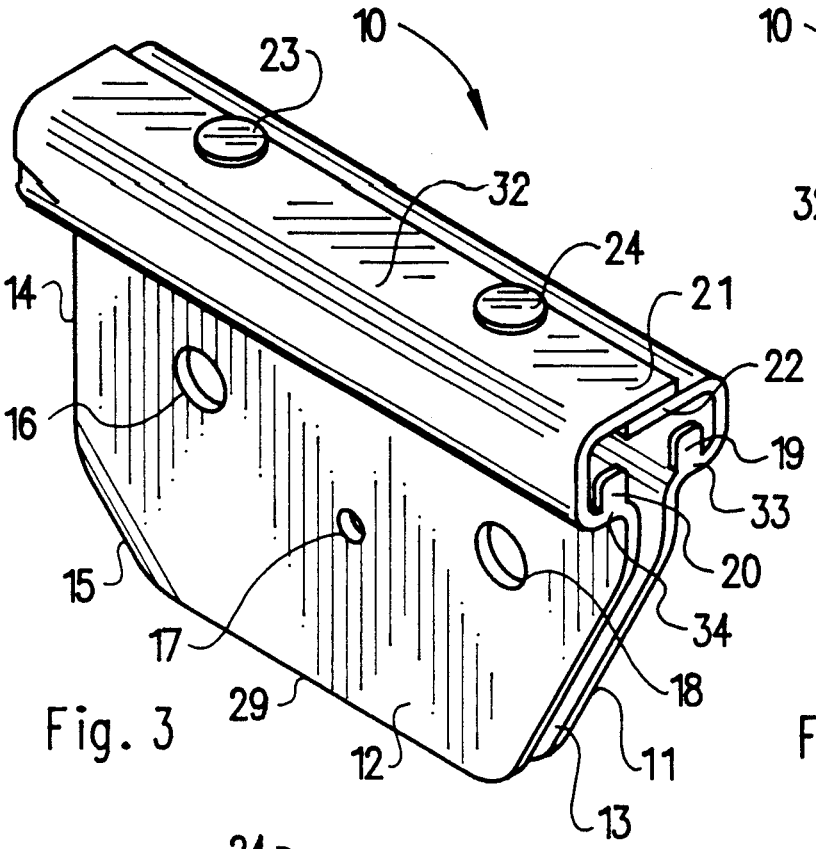
FIG. 3 is a left end perspective view of the speed square holder of FIG. 1.
Figure 5:
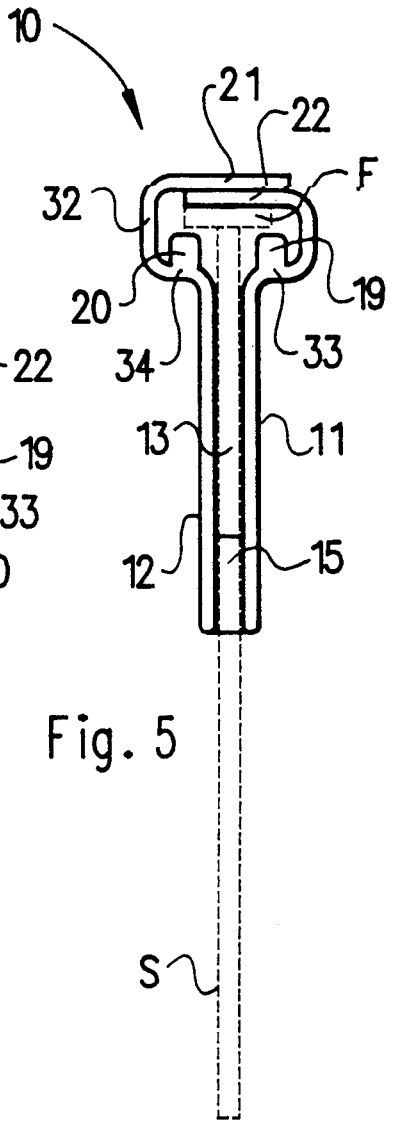
FIG. 5 is a left end view of the speed square holder of FIG. 1, illustrating the manner of removing a speed square from the holder.
Figure 4:
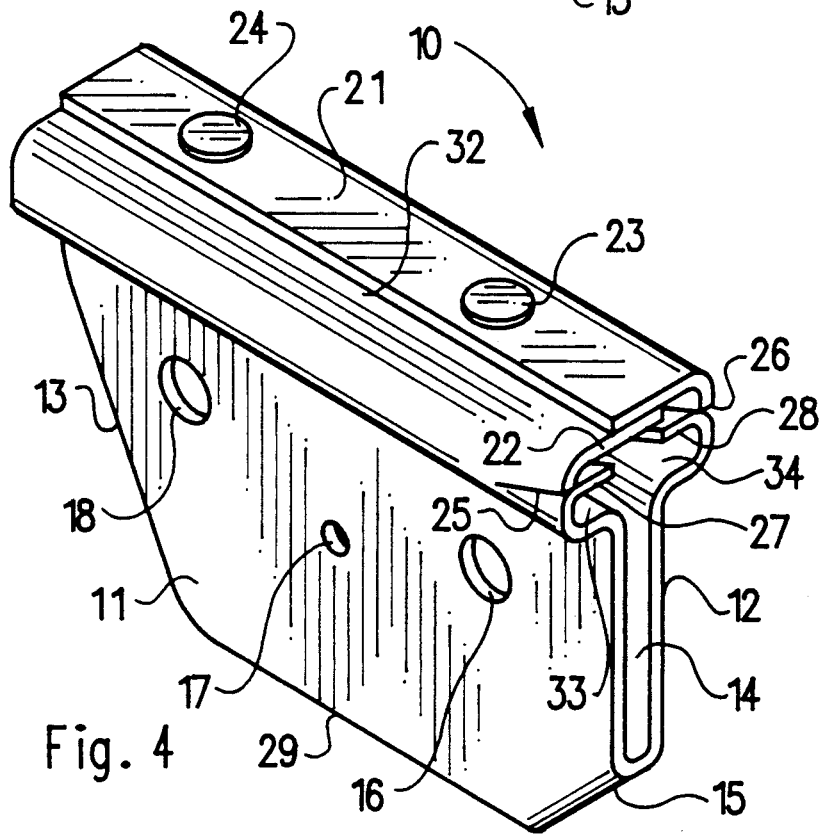
FIG. 4 is a right end perspective view of the speed square holder of FIG. 1.

As shown in FIG. 1, the rear wall 15 abuts a side of the speed square S forming the hypotenuse. An elongated, rectangular tubular portion 32 is formed along top edges of the side panels 11 and 12, for example, by bending edge portions 21 and 22 into the illustrating overlying position and securing with rivets 23 and 24. The tubular portion 32 possesses a floor with a central opening communicating with the hollow interior portion and defining aligned, opposed, spaced ledge members 33 and 34 which serve as support means for the flange F of the square S, as shown in FIGS. 3 and 4. The holder 10 thus has a transverse cross-sectional shape which is generally T-shaped. The ledge members 33 and 34 abut the transverse flange F of the square S. As illustrated in FIG. 5, stop means in the form of a pair of upstanding tabs 19 and 20 disposed on the ledge members adjacent the front opening 13, on opposite sides of the central opening between the ledges 33 and 34, engage a leading edge of the transverse flange F, when the flange F is in a lowered position. As shown in FIG. 3, the tabs 19 and 20 may be substantially perpendicular to the ledges 33 and 34, or the tabs 19' and 20' may be oblique to the ledges 33 and 34, as shown in the modified holder 10' illustrated in FIG. 7.

Juxtaposed inclined ramps 27 and 28 extend inwardly from opposite sides of the tubular portion 32, above the ledge members 33 and 34, and adjacent the rear opening 14. The inclined ramps 27 and 28 abut a rear portion of the transverse flange of the square S, to maintain the leading edge of the transverse flange in engagement with the tabs 19 and 20, and allow removal of the speed square S through the front opening 13 by raising the leading edge above the tabs, as shown in FIG. 5. The ramps 27 and 28 are formed by making inclined slits 25 and 26 in opposite side walls of the tubular portion 32, and bending the separated lower side wall portions inwardly, as can be appreciated from FIGS. 2 and 4. It should be noted that the purpose of the inclined ramps 27 and 28 is to dispose the speed square in an inclined orientation in the holder 10, such that gravity urges the leading edge of the flange F downwardly into engagement with the tabs 19 and 20. This downward inclination can also be provided by suitable inclination of the rear wall 15, or by inclining the ledges 33 and 34.

The speed square holders 10 and 10' according to the invention may be formed from deformed sheet metal through a die stamping process, or may be molded from plastic or other suitable materials.

To place a speed square S into the holder 10 or 10', the flange F of the square S is positioned between the folded edge portion 22 and the tabs 19 or 19' and 20 or 20', as shown in FIG. 5. The speed square is then pushed into the holder 10 or 10', in a direction parallel with a longitudinal axis of the flange F, until the side of the square forming the hypotenuse abuts the inclined wall 15. The holder 10 or 10' is dimensioned such that the leading edge of the flange F will drop down behind the tabs 19 or 19' and 20 or 20' just before the hypotenuse side of the square S abuts the rear wall 15. The square S is then captured between the tabs 19 or 19' and 20 or 20' and the rear wall 15. As described previously, the holder 10 or 10' is preferably constructed so as to maintain the leading edge of the flange F of square S below the trailing edge when the square S is in a rest position within the holder, so as to prevent the flange F of the square S from unintentionally sliding out above the tabs 19 or 19' and 20 or 20'. This objective may be achieved, as described previously, by the use of ramps 27, 28, by suitably inclining the rear wall 15, or by inclining the ledges 33 and 34. Additionally, it is contemplated that a single tab may employed in place of tabs 19 or 19' and 20 or 20', without departing from the intended scope of the present invention.

To remove the square S from the holder 10 or 10', it is merely necessary to grasp the forward edge of the square and pull forwardly and upwardly. As can now be appreciated, the present invention maintains the square S securely in place, while allowing rapid withdrawal and replacement in a "quick draw" manner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to,

What is claimed as being new and desired to be protected by LETTERS PATENT of the United States is as follows:

1. A holder for a generally right triangular speed square having a transverse flange extending along one side, said holder comprising:

a housing having a hollow interior portion dimensioned for at least partial reception of a speed square;

a front opening in said housing communicating with said hollow interior portion and dimensioned for at least partial insertion of the speed square in a direction parallel with a longitudinal axis of the transverse flange of the speed square;

support means in said housing dimensioned for at least partial abutment with the transverse flange of the speed square; and stop means in said housing dimensioned for abutment with a leading edge of the transverse flange of the speed square to prevent removal of the speed square through said front opening in said housing.

2. The holder of claim 1, wherein said stop means is disposed to allow removal of the speed square when the leading edge of the transverse flange of the speed square is lifted above said stop means.

3. The holder of claim 1, wherein said stop means extends upwardly from said support means.

4. The holder of claim 1, further comprising means for supporting a trailing edge of the transverse flange of the speed square above the leading edge of the transverse flange of the speed square.

5. The holder of claim 1, further comprising at least one inclined ramp in said housing disposed for supporting a trailing edge of the transverse flange of the speed square above the leading edge of the transverse flange of the speed square.

6. The holder of claim 1, further comprising means in said housing disposed for abutment with a side of the speed square forming the hypotenuse of the right angle of the speed square.

7. The holder of claim 1, further comprising means in said housing disposed for abutment with a side of the speed square forming the hypotenuse of the right angle of the speed square and dimensioned to support a trailing edge of the transverse flange of the speed square above the leading edge of the transverse flange of the speed square.

8. The holder of claim 7, wherein said stop means is disposed to allow removal of the speed square when the leading edge of the transverse flange of the speed square is lifted above said stop means.

9. The holder of claim 1, wherein said stop means comprises at least one tab extending upwardly from said support means.

10. The holder of claim 9, wherein said at least one tab extends substantially perpendicular to said support means.

11. The holder of claim 9, wherein said at least one tab extends obliquely to said support means.

12. The holder of claim 1, wherein said support means comprises a pair of juxtaposed ledge members separated by a central opening.

13. A holder for a generally right triangular speed square having a transverse flange extending along one side, said holder comprising:

a pair of spaced, substantially parallel and substantially planar side panels defining a hollow interior portion dimensioned for at least partial reception of a speed square;

a front opening between said side panels communicating with said hollow interior portion and dimensioned for at least partial insertion of the speed square;

a pair of juxtaposed ledges extending along top edges of said side panels, on opposite sides of said front opening and disposed for at least partial abutment with the transverse flange of the speed square;

stop means on said holder disposed for abutment with a leading edge of the transverse flange of the speed square to maintain the speed square in the holder; and means on said holder for supporting a trailing edge of the transverse flange of the speed square above the leading edge of the transverse flange of the speed square and for allowing removal of the speed square from said holder through said front opening when the leading edge of the transverse flange of the speed square is raised.

14. The holder of claim 13, further comprising at least one inclined ramp in said housing disposed for supporting a trailing edge of the transverse flange of the speed square above the leading edge of the transverse flange of the speed square.

15. The holder of claim 13, further comprising means in said housing disposed for abutment with a side of the speed square forming the hypotenuse of the right angle of the speed square.

16. The holder of claim 13, further comprising means in said housing disposed for abutment with a side of the speed square forming the hypotenuse of the right angle of the speed square and dimensioned to support a trailing edge of the transverse flange of the speed square above the leading edge of the transverse flange of the speed square.

17. The holder of claim 13, wherein said stop means comprises at least one stop member extending substantially upwardly from at least one of said ledges.

18. The holder of claim 17, wherein said at least one stop member extends substantially perpendicular to said at least one ledge.

19. The holder of claim 17, wherein said at least one stop member extends obliquely to said at least one ledge.

20. A holder for a generally right triangular speed square having a transverse flange extending along one side, said holder comprising:

a pair of side panels disposed in spaced, substantially parallel relation;

a plurality of apertures in said side panels for use in securing said holder to a carpenter's apron;

said side panels defining a hollow interior having front, rear and bottom openings in the form of elongated slots;

an inclined rear wall connecting said side panels and separating said rear and bottom openings, said rear wall dimensioned for abutment with a side of the speed square forming the hypotenuse of the right angle of the speed square;

an elongated, generally rectangular tubular portion formed along top edges of said side panels, said rectangular tubular portion having a floor with a central opening communicating with said hollow interior portion and defining juxtaposed ledge members, said ledge members dimensioned for abutment with the transverse flange of the speed square;

a pair of upstanding tabs on said ledge members, adjacent said front opening, said tabs disposed on opposite sides of said central opening and dimensioned for engagement with a leading edge of the transverse flange of the speed square; and a pair of juxtaposed inclined ramps extending inwardly from opposite sides of said tubular portion, above said ledge members, and adjacent said rear opening, said inclined ramps dimensioned for abutment with a rear portion of the transverse flange of the speed square to maintain the leading edge of the transverse flange of the speed square in engagement with said tabs.

* * * * *